US005774894A

United States Patent [19]

Yates et al.

[11] Patent Number: 5,774,894

[45] Date of Patent: *Jul. 7, 1998

[54] THERMAL MITTEN FOR GOLFERS

[76] Inventors: James W. Yates, Rte. 1, Box 585; Ronnie L. Yates, P.O. Box 3441, both of Wise, Va. 24293

[ * ] Notice: The term of this patent shall not extend beyond the expiration date of Pat. Nos. 5,509,143 and 5,617,583.

[21] Appl. No.: 805,647

[22] Filed: Feb. 27, 1997

[51] Int. Cl.[6] ..... A41D 19/01

[52] U.S. Cl. ..... 2/158; 2/160; 2/161.2

[58] Field of Search ..... 2/158, 161.2, 160.1, 2/161.1, 161.6

[56] References Cited

U.S. PATENT DOCUMENTS

| | | | |
|---|---|---|---|
| 1,970,081 | 8/1934 | Eisendrath . | |
| 2,242,318 | 5/1941 | Mosier | 2/161.2 |
| 4,535,482 | 8/1985 | Spector et al. | 2/160 |
| 4,543,671 | 10/1985 | Monk . | |
| 4,651,350 | 3/1987 | Dawiedczyk . | |
| 5,230,333 | 7/1993 | Yates et al. . | |
| 5,509,143 | 4/1996 | Yates et al. . | |
| 5,617,583 | 4/1997 | Yates et al. | 2/158 |

*Primary Examiner*—Diana Biefeld

*Attorney, Agent, or Firm*—Laubscher & Laubscher

[57] ABSTRACT

A thermal mitten includes a first end portion containing an opening through which the user introduces his hand into a chamber contained within the mitten, the second end portion of the mitten containing a pocket for receiving a warming device to warm the user's fingers, characterized by the provision of a palm opening contained in the palm portion of the mitten, thereby to permit gripping of a steering wheel or the like by the palm portion of the user's hand. When the user's fingers are slipped out from the second end portion, the second end portion may be folded back toward a retracted inoperative position against the back of the mitten body portion, at least one restraining device being provided for retaining the second end portion in place with sufficient force as to permit a user to grip a golf club and strike a golf ball. A thumb portion is provided on the mitten which is foldable back to a retained position between the second end portion and the back of the mitten body portion.

10 Claims, 4 Drawing Sheets

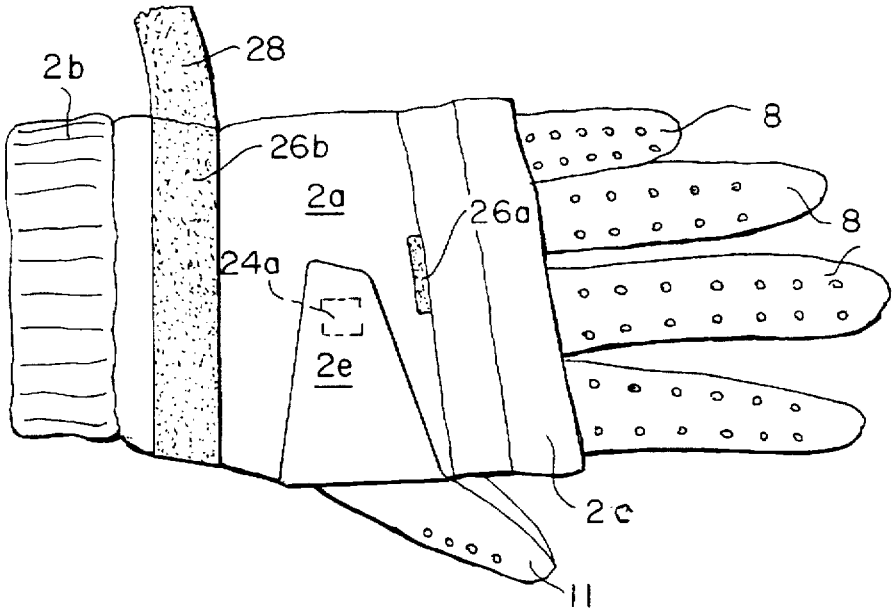
FIG. 7
FIG. 8
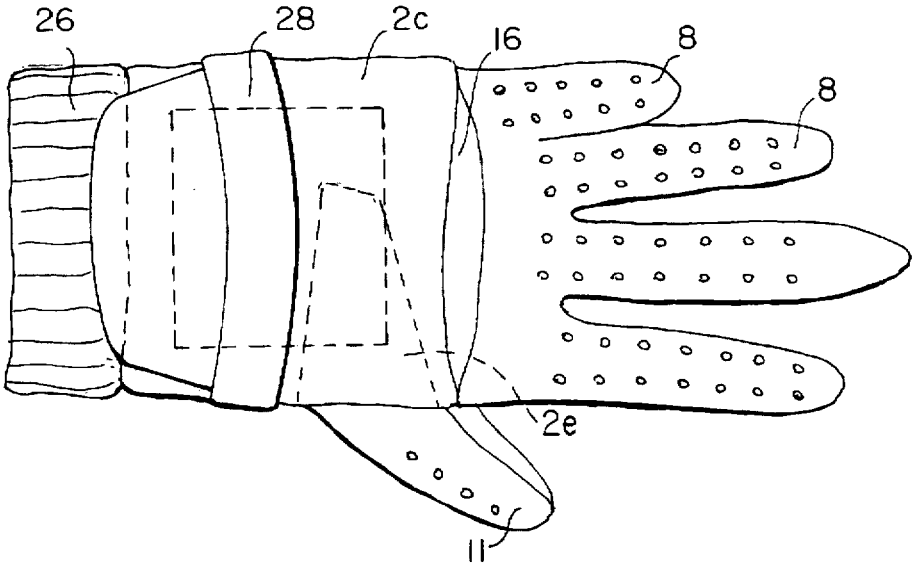

THERMAL MITTEN FOR GOLFERS

BACKGROUND OF THE INVENTION

1. Field of the Invention

A thermal mitten for golfers and the like is disclosed including a flexible mitten body containing a chamber for receiving the user's hand via an opening contained in a first end portion of the body, said body having a second end portion for receiving the user's fingers, a back portion connecting said first and second end portions, and a palm portion containing a palm opening of such dimensions as to permit the gripping by the user's palm of the steering wheel of a vehicle, such as a golf cart. The second end portion is provided with a pouch for receiving heating means heat the user's fingers, the transverse dimension of the palm opening being such as to permit said second end portion to be folded back to an inoperative position adjacent the back portion of the mitten body. Retaining means firmly maintain the second end portion in the inoperative position, thereby to permit the user to grip a golf club for the striking of the golf ball.

2. Brief Decription of the Prior Art

As evidenced by the prior Yates et al U.S. Pat. Nos. 5,230,333 and 5,509,143 it is known to provide for hunters and other outdoorsmen thermal gloves or mittens having end portions provided with pockets for receiving heating devices that heat the user's fingers, which end portions are foldable back to inoperative positions adjacent the rear portion of the glove or mitten body, thereby exposing the user's fingers for a desired task (such as, for example, the firing of a rifle). Other types of thermal gloves or mittens are shown by the patents to Dawiedezyk U.S. Pat. No. 4, 651,350 Eisendrath U.S. Pat. No. 1,970,081 and Monk U.S. Pat. No. 4,543,671.

One problem experienced with such thermal gloves or mittens is that it is difficult for a user wearing the thermal gloves or mittens to drive a motor vehicle, owing to the slipperiness of the palm portion of the glove or mitten relative to the steering wheel of the vehicle. This is particularly true when the mitten or glove is formed from a felt or woven material, such as wool. Also, thermal gloves of the prior art are not suitable for use by golfers, since the palm portions of the wearer's hands are covered by the palm portions of the gloves. Also, golfers could not use the gloves when driving a golf cart between shots, owing to the aforementioned slipperiness between the gloves and the steering wheel of the golf cart.

Accordingly, the thermal mitten of the present invention was developed to avoid the above and other drawbacks of the known thermal mittens or gloves, and to provide an improved thermal mitten that is particularly suitable for use by drivers of vehicles in general, and, more particularly, to golfers who drive golf carts.

SUMMARY OF THE INVENTION

Accordingly, a primary object of the present invention is to provide an improved thermal mitten having a flexible cloth body containing a chamber for receiving the user's hand via an opening contained in a first end of the mitten body, the other end of the mitten body which receives the user's fingers being provided with a pocket for receiving a heating device, characterized in that the mitten body has a palm portion containing a palm opening, thereby affording access to the user's palm for engaging the steering wheel of a vehicle, such as a golf cart. The dimensions of the palm opening are such as to permit the second end portion of the mitten to be slipped off of the user's fingers and to be folded back to an inoperative position against the rear portion of the mitten. Retaining means are provided for retaining the mitten second end portion in the inoperative position, thereby to permit a golfer to grip a club and to strike a golf ball while wearing the thermal mitten.

According to another object of the invention, the mitten Is provided with a thumb portion that is removable from the user's thumb for folding to a retained position between the mitten second portion, when in the inoperative position, and the back portion of the mitten. Fastener means, such as a pair of cooperating VELCRO (hook and loop fastener) strips, may be used to maintain the thumb portion in the retained position relative to the mitten back portion, and to maintain the mitten second portion in the inoperative position relative to the mitten body, with the thumb portion retained therebetween. Furthermore, retaining strap means may extend externally across the mitten second portion to maintain the same in the inoperative position.

BRIEF DESCRIPTION OF THE DRAWING

Other objects and advantages of the invention will become apparent from a study of the following specification, when viewed in conjunction with the accompanying drawings, in which:

FIG. 7 is a top plan view of the thermal mitten with the finger-heating end and thumb portions in their partially retracted positions of Fig. 3; and FIG. 8 is a top plan view of the thermal glove in the inoperative condition of FIG. 4.

DETAIL DESCRIPTION

Figure 1:
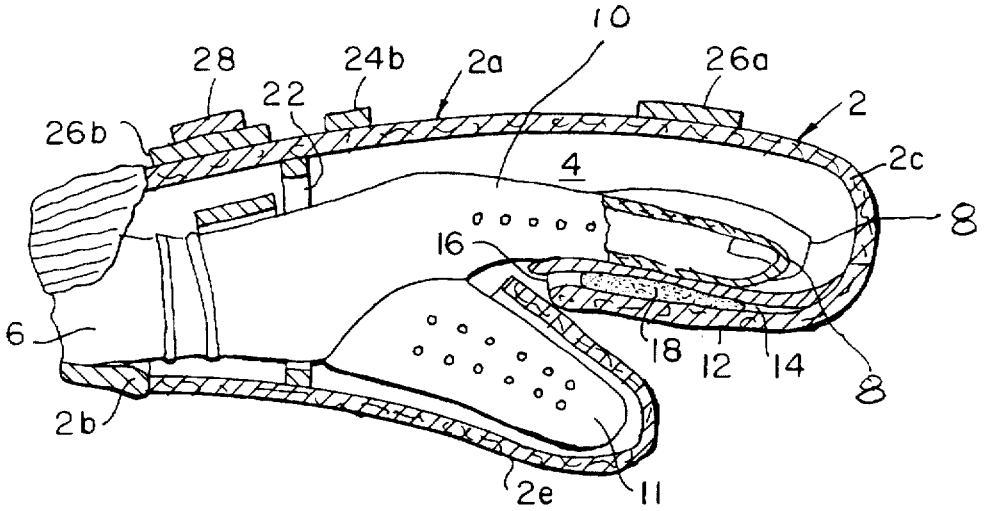
FIG. 1 is a longitudinal sectional view of the thermal mitten of the present invention when worn over the hand of a user wearing a conventional golf glove, the mitten being in its normal finger-warming condition.
Figure 5:
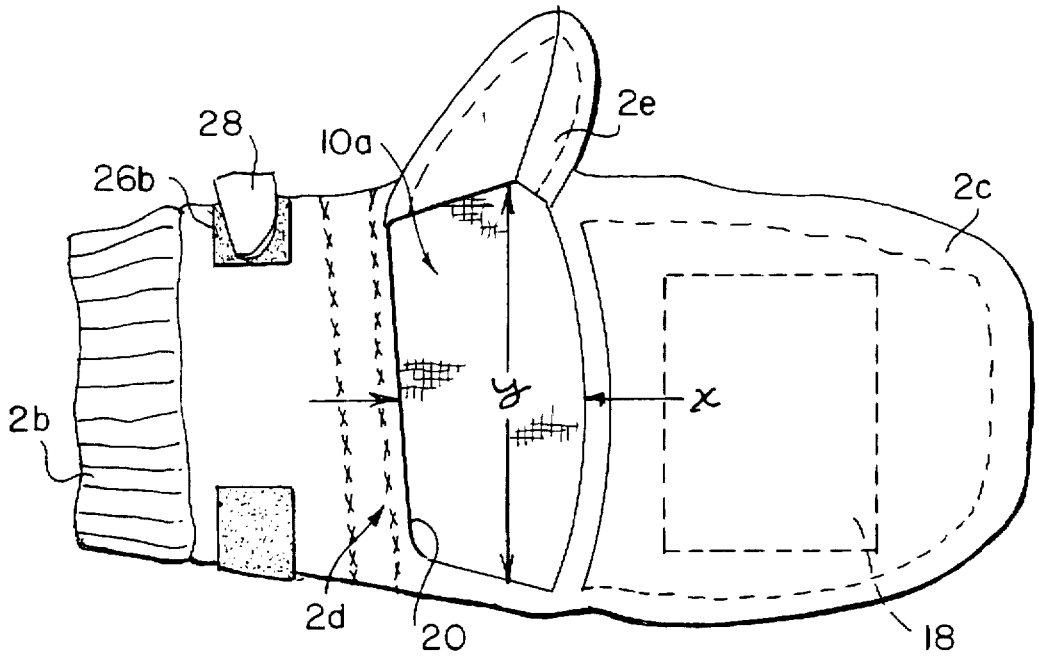
FIG. 5 is a bottom plan view of the mitten of Fig. 1.
Figure 6:
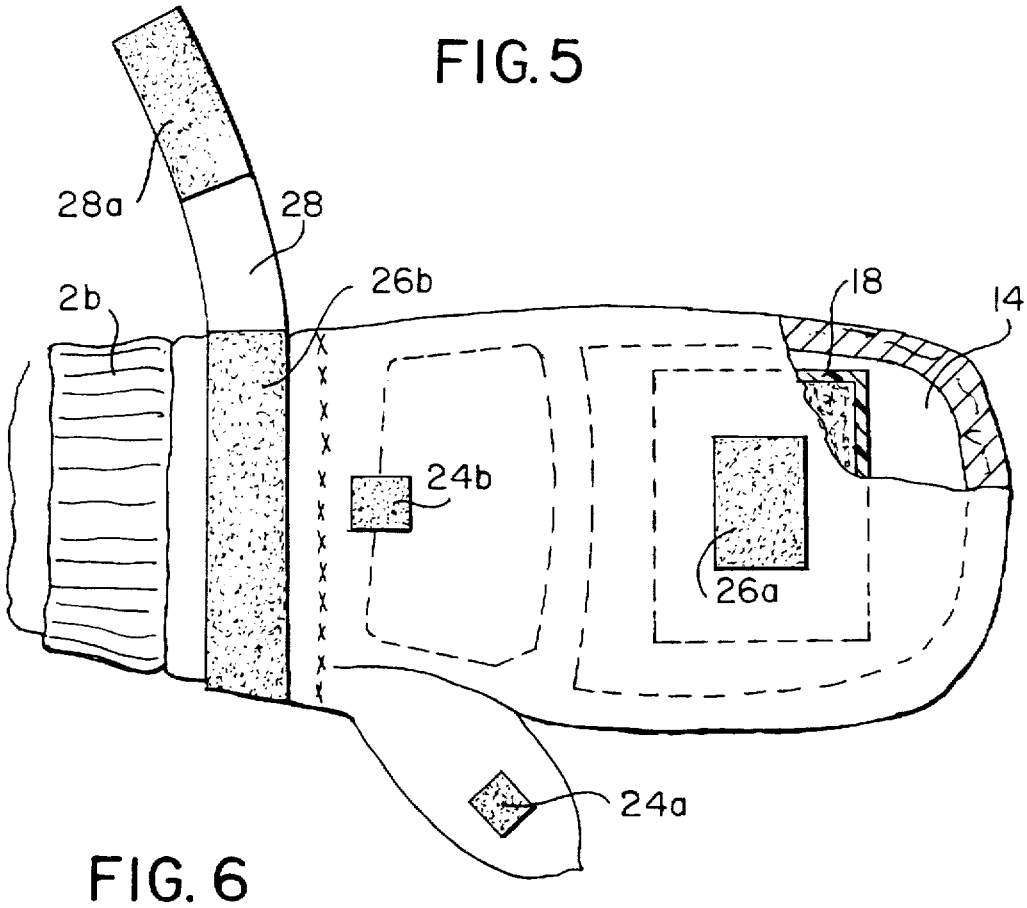
FIG. 6 is a top plan view of the thermal mitten of FIG. 1 with the retaining strap in its released condition.

Referring first more particularly to FIGS. 1, 5 and 6, the thermal mitten 2 of the present invention is formed from a suitable flexible material, such as felt or knitted material, such as wool, and includes a body portion 2*a* containing a hand-receiving chamber 4, a first end portion 2*b* containing an opening 6 through which the user's hand is inserted into chamber 4. At its other end, the mitten includes a second finger-heating end portion 2*c* that receives the fingers 8 of the user, who is shown as wearing a conventional golf glove 10. The bottom of the second end portion is provided with a sewn layer 12 defining a pocket 14 having an opening 16 through which a conventional oxygen-activated chemical heating packet 18 is introduced. As shown in FIG. 5, the mitten includes also a palm portion 2*d* containing a palm opening 20 that exposes the palm portion 10*a* of the user's golf glove 10, and a thumb portion 2*e* that is connected with the back of the mitten body portion. An annular elastic band 22 is sewn concentrically within the chamber 4 between the palm opening 20 and the mitten first end 2b, thereby to draw the associated mitten portion radially inwardly toward the wrist of the user.

Figure 2:
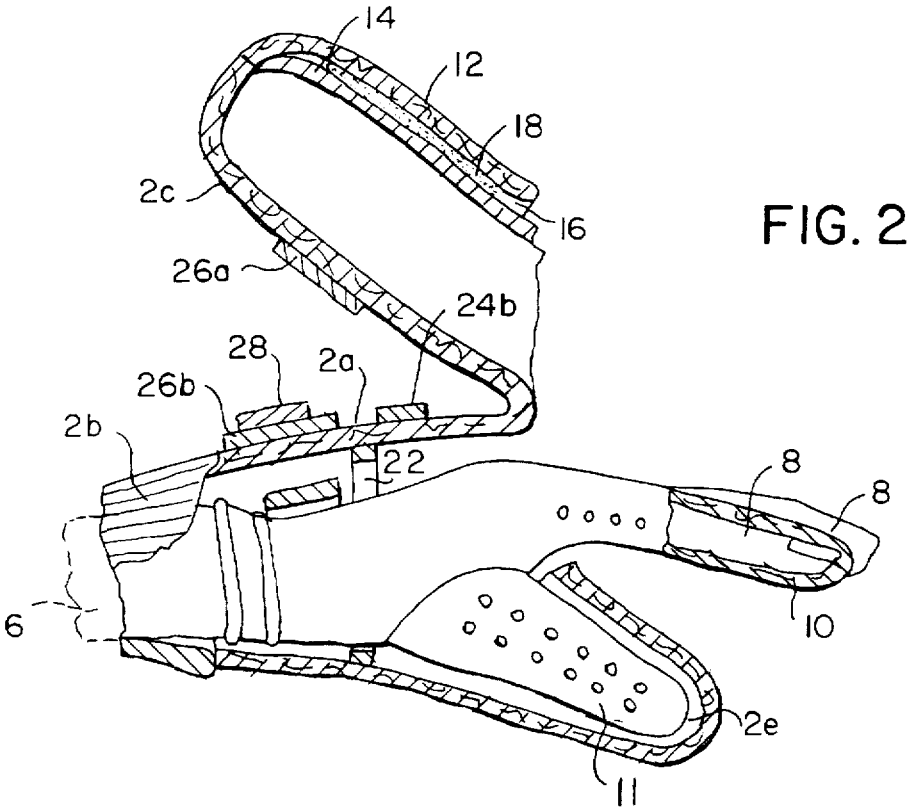
FIG. 2 is a sectional view of the thermal mitten of FIG. 1 illustrating the finger-heating end portion of the mitten being released and initially folded backwardly toward the inoperative non-heating position.
Figure 3:
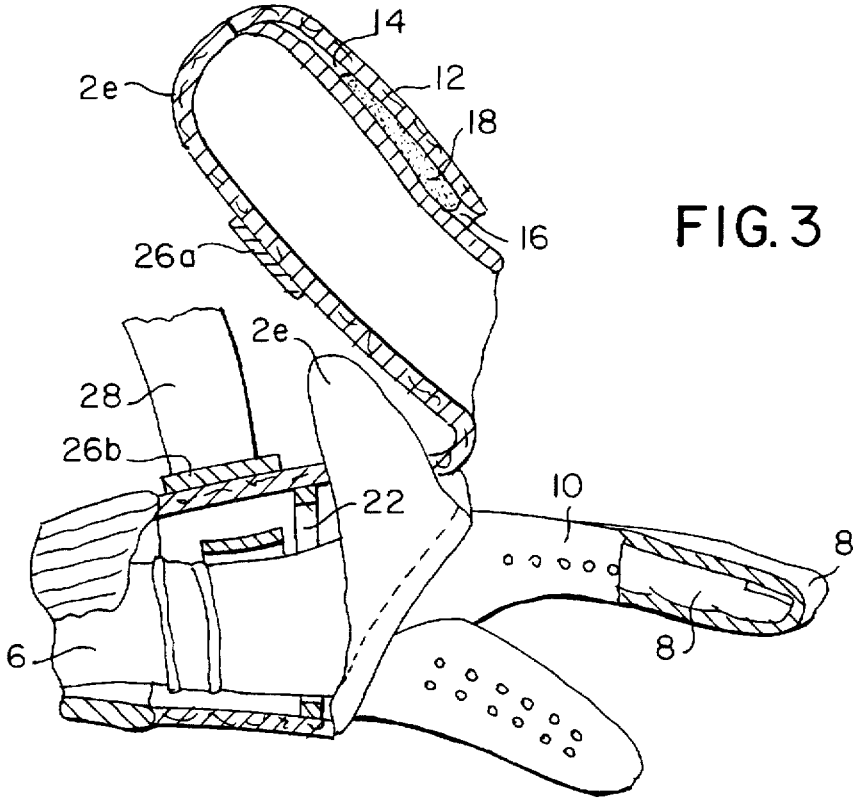
FIG. 3 is a sectional view illustrating the thumb portion of the mitten being folded backwardly and inwardly toward the retained position between the finger-heating end portion and the back portion of the mitten.
Figure 4:
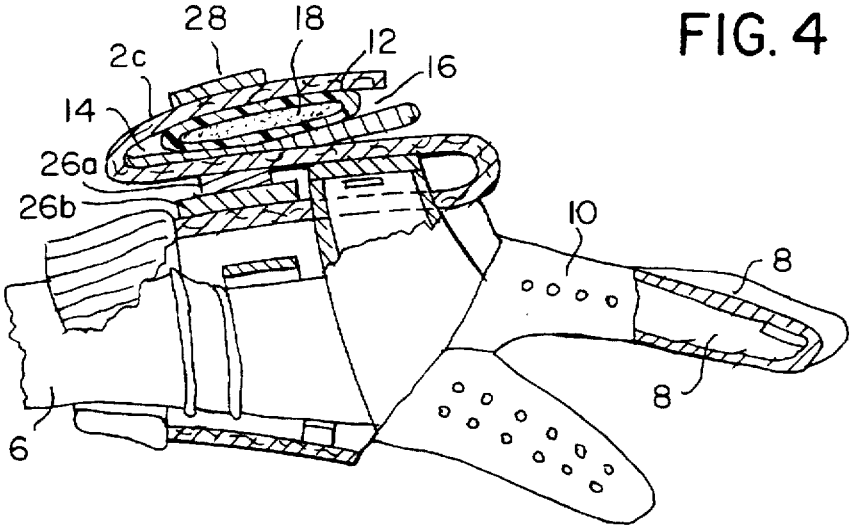
FIG. 4 is a longitudinal sectional view illustrating the thermal mitten with the finger-heating end portion retained in its fully retracted inoperative position.

As shown in FIG. 5, the palm opening has longitudinal and transverse dimensions x and y sufficient to expose a substantial portion of the palm 10a of the user's golf glove. Furthermore, these dimensions are such that when the user's fingers are slipped out of the mitten second end portion, the second end portion can be folded rearwardly toward the back of the mitten body portion 2a as shown in FIG. 2. Similarly, the thumb portion 2e of the mitten can be slipped from the user's thumb 11 and folded upwardly and inwardly between the second end portion 2c and the back of the mitten body portion, as shown in FIG. 3. In order to maintain engagement between between the thumb and back portions these portions are provided with cooperating VELCRO (hoop and loop fastener) strips 24a and 24b, respectively, as best shown in FIG. 6. The second end back portions of the mitten are similarly provided with cooperating VEICRO strips 26a and 26b, respectively. Initially a retaining strap 28 secured at one end with the mitten body portion is connected with the VELCRO strip 26b by a VELCRO strip 28a, which strip is released from the VELCRO strip 26b when the second end portion is folded rearwardly toward the FIG. 3 position. After the second end portion 2c reaches the FIG. 4 position to cause engagement between VELCRO strips 6a and 26b, the retaining strip 28 is folded over the second end portion 2c, thereby to firmly maintain the second end portion in place.

Operation

Assuming that the mitten is in the normal finger-heating condition of FIGS. 1, 5 and 6, the user's palm is exposed through the palm opening 20 of FIG. 5, thereby to permit the user to grip the steering wheel of a vehicle (i.e., in the case of a golfer, a golf cart) in a firm non-slip manner. In order to convert the glove to the inoperative condition of FIGS. 4 and 8, the strip 28 is released from the VELCRO strip 26b and shown in FIG. 3, the user's fingers are slipped out of the second end portion 2c, and the user's thumb is slipped out of the thumb portion 2e. The thumb portion 2e is folded back to the FIG. 3 position between the second end portion 2c and the back of the mitten body portion 2a, whereupon the VELCRO retaining strips 24a and 24b are brought into engagement. The second end portion is then folded over the thumb portion, and the VELCRO strips 26a and 26b are brought into engagement, whereupon the retaining strap 28 is brought over the folded thumb and second end portions to retain the same in place with sufficient strength to permit the user to grip a golf club and to strike a golf ball.

Although the thermal mitten has been described for use by a golfer wearing a golf glove, it is apparent that a golfer could use the thermal mitten without using a golf glove under the mitten. Furthermore, the mitten could be used in many other outdoors activities where gripping of an object is important (such as gripping the poles used in cross country skiing, for example).

While in accordance with the provisions of the Patent Statutes the preferred forms and embodiments have been illustrated and described, it will beapparent to those skilled in the art that various monifications and changes may be made without deviating from the inventive concepts set forth above.

What is claimed is:

1. A thermal mitten, comprising:

(a) a mitten body formed of a flexible material, said mitten body containing a chamber for receiving a user's hand, said mitten including:

(1) a first end portion containing an opening through which [the] a user's hand may be introduced into said chamber;

(2) a generally cup-shaped second end portion for normally receiving a user's fingers;

(3) a back portion connecting said first and second end portions, said back portion normally extending along the back of a user's hand;

(4) a palm portion containing intermediate said first and second end portions a palm opening which is designed to coincide with a user's palm, (a) said palm opening having such a first dimension (x) in the longitudinal direction of said mitten body between said first and second end portions as to expose a substantial portion of a user's palm, thereby to permit the gripping of a steering wheel thereby;

(b) said palm opening having such a transverse dimension (y) relative to the longitudinal axis of said mitten body as to permit said second end portion to be slipped off of a user's fingers and to be folded back to an inoperative position adjacent said mitten body back portion;

(b) means defining on said mitten body second end portion a pocket for receiving a heating means, thereby to heat a user's fingers; and (c) retaining means for retaining said second end portion in said inoperative position relative to said mitten body.

2. A thermal mitten as defined in claim 1, and further including:

(d) a generally cup-shaped thumb portion connected with said mitten body back portion for normally receiving a user's thumb, said thumb portion being operable to be slipped off a user's thumb and to be folded back to a retained position extending partially between said second end portion and said mitten body back portion when said second end portion is in said inoperative position, whereby when the thermal mitten is worn over a conventional golf glove, a user may grip a golf club for the striking of a golf ball without removing the golf mitten.

3. A thermal mitten as defined in claim 2, wherein said means for retaining said second end portion in said inoperative position includes a first pair of cooperating hook and loop fasteners on said mitten body second end portion and on said back portion, respectively.

4. A thermal mitten as defined in claim 3, wherein said retaining means includes a strap that includes a pair of end portions that are connected with said mitten body portion, and an intermediate portion that extends over said second end portion when said second end portion is in said inoperative position.

5. A thermal mitten as defined in claim 2, and further including means for connecting said thumb portion, when in said retained position, with said mitten body back portion.

6. A thermal mitten as defined in claim 5, wherein said thumb portion connecting means includes a second pair of cooperating hook and loop fasteners fastened to said thumb and back portions, respectively.

7. A thermal mitten as defined in claim 2, and further including:

(e) generally annular radially-inwardly-biased elastic means mounted on said mitten body concentrically about said chamber intermediate said one body end and said palm opening.

8. A thermal mitten as defined in claim 7, wherein said elastic means comprises a circular band, said band being arranged intermediate said thumb portion and said mitten body one end.

9. A thermal mitten as defined in claim 2, wherein said palm opening extends transversely of said mitten body portion generally to the base of said thumb portion.

10. A thermal mitten as defined in claim 1, wherein said retaining means includes a first pair of cooperating hook and loop fasteners connected with said second end portion and with said back portion, respectively.

* * * * *